US010468840B2

(12) United States Patent
Schaub et al.

(10) Patent No.: US 10,468,840 B2
(45) Date of Patent: Nov. 5, 2019

(54) ALTERNATING CURRENT (AC) INLET AND OUTLET ASSEMBLY

(71) Applicant: Black & Decker Inc., New Britain, CT (US)

(72) Inventors: Michael J. Schaub, Nottingham, MD (US); Daniel L. Schwarz, Timonium, MD (US); Nancy L. Chung, Silver Spring, MD (US)

(73) Assignee: Black & Decker Inc., New Britain, CT (US)

( * ) Notice: Subject to any disclaimer, the term of this patent is extended or adjusted under 35 U.S.C. 154(b) by 0 days.

(21) Appl. No.: 16/018,595

(22) Filed: Jun. 26, 2018

(65) Prior Publication Data

US 2019/0006803 A1 Jan. 3, 2019

Related U.S. Application Data

(60) Provisional application No. 62/526,440, filed on Jun. 29, 2017.

(51) Int. Cl.
*H01R 25/00* (2006.01)
*H01R 13/52* (2006.01)
(Continued)

(52) U.S. Cl.
CPC ..... *H01R 25/006* (2013.01); *F21S 8/035* (2013.01); *F21V 23/023* (2013.01); *F21V 23/06* (2013.01); *F21V 33/00* (2013.01); *H01R 13/52* (2013.01); *H01R 13/5202* (2013.01); *H01R 13/5213* (2013.01); *H01R 13/567* (2013.01); *H01R 13/60* (2013.01); *H01R 13/665* (2013.01); *H01R 24/78* (2013.01); *H01R 2103/00* (2013.01)

(58) Field of Classification Search
CPC .... H01R 24/525; H01R 24/78; H01R 24/006; H01R 31/06; H01R 13/6395
USPC ..... 439/535, 536
See application file for complete search history.

(56) References Cited

U.S. PATENT DOCUMENTS 3,798,540 A 3/1974 Darden et al.
4,659,161 A 4/1987 Holcomb
(Continued)

FOREIGN PATENT DOCUMENTS

CA 2639031 1/2010

OTHER PUBLICATIONS

Extended EP search report dated Nov. 27, 2018 issued in corresponding EP application No. 18180086.3.

*Primary Examiner* — Tulsidas C Patel
*Assistant Examiner* — Marcus E Harcum
(74) *Attorney, Agent, or Firm* — Amir Rohani

(57) ABSTRACT

An electrical inlet/outlet assembly is provided including an Alternating Current (AC) inlet having at least a line terminal and a neutral terminal arranged to receive electric power from a power supply via a first power, and an AC outlet having at least a line terminal and a neutral terminal arranged to supply electric power from the AC inlet to an electrical device. Channels are provided extending respectively between the line and neutral terminals of the AC inlet and the line and neutral terminals of the AC outlet, and connectors are disposed within the channels to electrically connect the line and neutral terminals of the AC inlet respectively to the line and neutral terminals of the AC outlet. The channels forms water-sealed enclosures around the connectors.

14 Claims, 6 Drawing Sheets

(51) Int. Cl.

| | |
|---|---|
| ***H01R 24/78*** | (2011.01) |
| ***F21S 8/00*** | (2006.01) |
| ***F21V 23/02*** | (2006.01) |
| ***F21V 23/06*** | (2006.01) |
| ***F21V 33/00*** | (2006.01) |
| ***H01R 13/56*** | (2006.01) |
| ***H01R 13/60*** | (2006.01) |
| ***H01R 13/66*** | (2006.01) |
| *H01R 103/00* | (2006.01) |

(56) References Cited

U.S. PATENT DOCUMENTS

| | | | | |
|---|---|---|---|---|
| 4,959,018 | A | 9/1990 | Yamamoto | |
| 5,306,178 | A * | 4/1994 | Huang | H01R 13/5213 174/67 |
| 5,936,828 | A | 8/1999 | Nolan et al. | |
| 6,108,194 | A | 8/2000 | Seligman et al. | |
| 6,929,514 | B1 * | 8/2005 | Chuang | H01R 31/02 439/108 |
| 6,994,585 | B2 * | 2/2006 | Benoit | H01R 25/003 174/58 |
| 7,443,049 | B1 | 10/2008 | Jones et al. | |
| 7,815,332 | B1 | 10/2010 | Smith | |
| 7,862,385 | B2 | 1/2011 | Lee | |
| 7,892,036 | B2 | 2/2011 | Lee | |
| 7,988,494 | B2 | 8/2011 | Lee | |
| 8,138,430 | B1 | 3/2012 | Ucero | |
| 10,056,722 | B1 * | 8/2018 | Ingram | H01R 25/00 |
| 2008/0035507 | A1 | 2/2008 | Collister et al. | |
| 2008/0207046 | A1 * | 8/2008 | Arenas | H01R 9/2491 439/535 |
| 2010/0130036 | A1 | 5/2010 | Ziobro | |
| 2013/0040489 | A1 * | 2/2013 | Fang | H01R 25/006 439/536 |
| 2016/0126683 | A1 * | 5/2016 | DeCosta | H02G 1/00 439/535 |
| 2016/0285219 | A1 | 9/2016 | Leverton et al. | |

* cited by examiner

ALTERNATING CURRENT (AC) INLET AND OUTLET ASSEMBLY

RELATED APPLICATION

This application claims the benefit of U.S. Provisional Patent Application No. 62/526,440 filed Jun. 29, 2017, which is incorporated herein by reference in its entirety.

FIELD OF THE DISCLOSURE

This disclosure relates to an Alternating Current (AC) inlet/outlet assembly, and in particularly an AC inlet/outlet assembly for use in electrical apparatuses such as lighting devices.

BACKGROUND

Some products such as lighting devices are provided with both an AC inlet and an AC outlet that allow daisy chaining of the devices using a single electrical mains outlet. Conventionally, such products include separate and discreet AC inlet and outlets electrically joined together by electrical conductors such as wires. The conductors create an AC power passageway through the device and its working elements from the AC inlet to the AC outlet. Such conductors are prone to damage and wear over time, are difficult to assemble within the device, and are susceptible to electrical shorting in the presence of water and other contamination.

What is needed is a safe, reliable and easy to manufacture AC inlet/outlet assembly that overcomes the shortcomings of conventional designs.

SUMMARY

According to an embodiment, to overcome the shortcomings of conventional designs discussed above, a sealed inlet/outlet assembly is provided that provides sealed channels between the inlet and the outlet electrical terminals.

According to an embodiment, an electrical inlet/outlet assembly is provided including an Alternating Current (AC) inlet having at least a line terminal and a neutral terminal arranged to receive electric power from a power supply via a first power, and an AC outlet having at least a line terminal and a neutral terminal arranged to supply electric power from the AC inlet to an electrical device. Channels are provided extending respectively between the line and neutral terminals of the AC inlet and the line and neutral terminals of the AC outlet, and connectors are disposed within the channels to electrically connect the line and neutral terminals of the AC inlet respectively to the line and neutral terminals of the AC outlet. In an embodiment, the channels forms water-sealed enclosures around the connectors.

In an embodiment, the inlet/outlet assembly further includes a front face having a planar portion through which the AC inlet and AC outlet are disposed, a rear face opposite the front face, and lateral walls projecting rearwardly from the rear face to form the plurality of channels therebetween on the rear face.

In an embodiment, the channels are formed in parallel and separated via at least one of the lateral walls.

In an embodiment, a cover is disposed at the ends of the lateral walls opposite the rear face, and a gasket is disposed between the cover and the ends of the lateral walls to water-seal the plurality of channels.

In an embodiment, the inlet/outlet assembly includes an additional set of line and neutral terminals coupled to the connectors and projecting through the cover. In an embodiment, the cover is insert-molded or otherwise sealed around the periphery of the additional set of line and neutral terminals.

In an embodiment, the line and neutral terminals of the AC inlet and the line and neutral terminals of the AC outlet are arranged in a mirror-image arrangement, and the channels extend in parallel from the line and neutral terminals of the AC inlet to the line and neutral terminals of the AC outlet respectively along a plane that is substantially parallel to the planar portion of the front face.

In an embodiment, the AC inlet and the AC outlet are arranged at an angle of less than 180 degrees with respect to one another.

In an embodiment, each of the AC inlet and AC outlet additionally comprises a ground terminal.

According to an embodiment, an electrical device such as a light device is provided with the electrical inlet/outlet assembly of the invention described above. In an embodiment, the light device may additionally include a main body and a light portion mounted on the main body.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustration purposes only and are not intended to limit the scope of this disclosure in any way.

Corresponding reference numerals indicate corresponding parts throughout the several views of the drawings.

DETAILED DESCRIPTION

Figure 1:
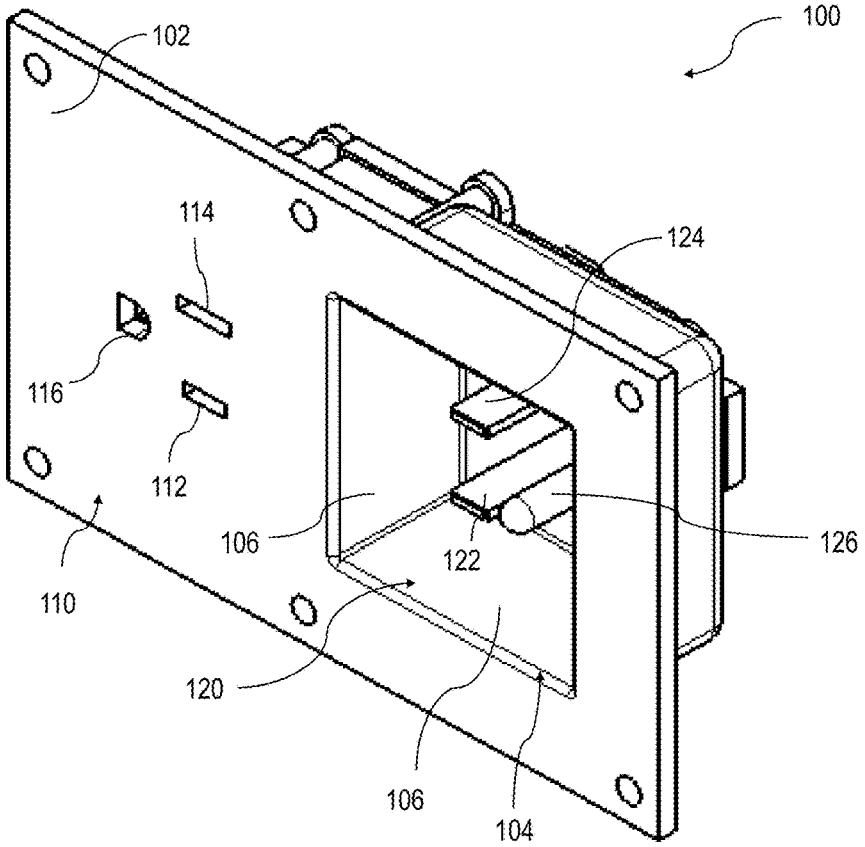
FIG. 1 depicts a perspective view of an AC inlet/outlet assembly, according to an embodiment.

The following description illustrates the claimed invention by way of example and not by way of limitation. The description clearly enables one skilled in the art to make and use the disclosure, describes several embodiments, adaptations, variations, alternatives, and uses of the disclosure, including what is presently believed to be the best mode of carrying out the claimed invention. Additionally, it is to be understood that the disclosure is not limited in its application to the details of construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting.

Figure 2:
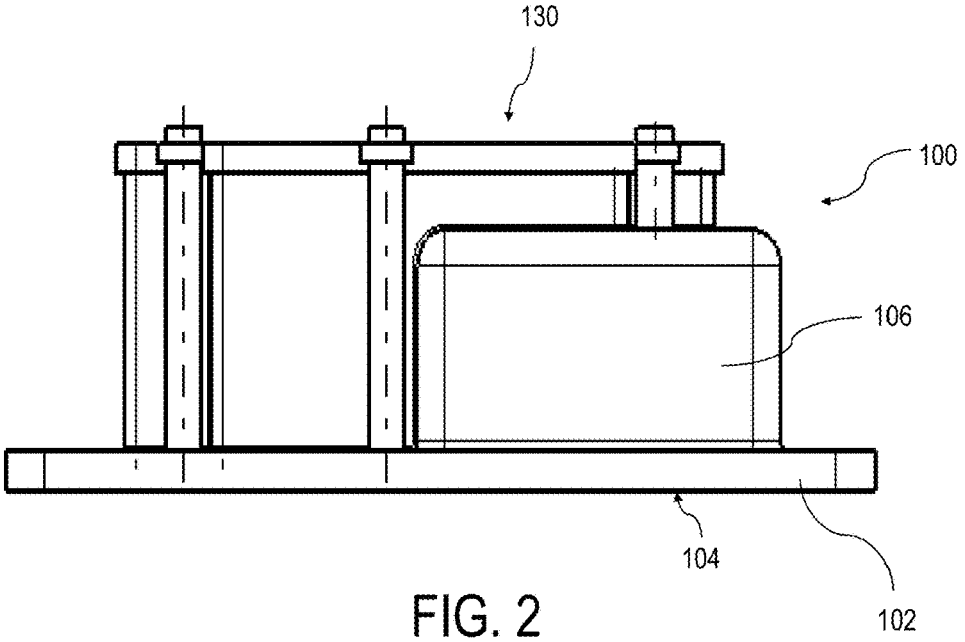
FIG. 2 depicts a side view of the AC inlet/outlet assembly, according to an embodiment.
Figure 3:
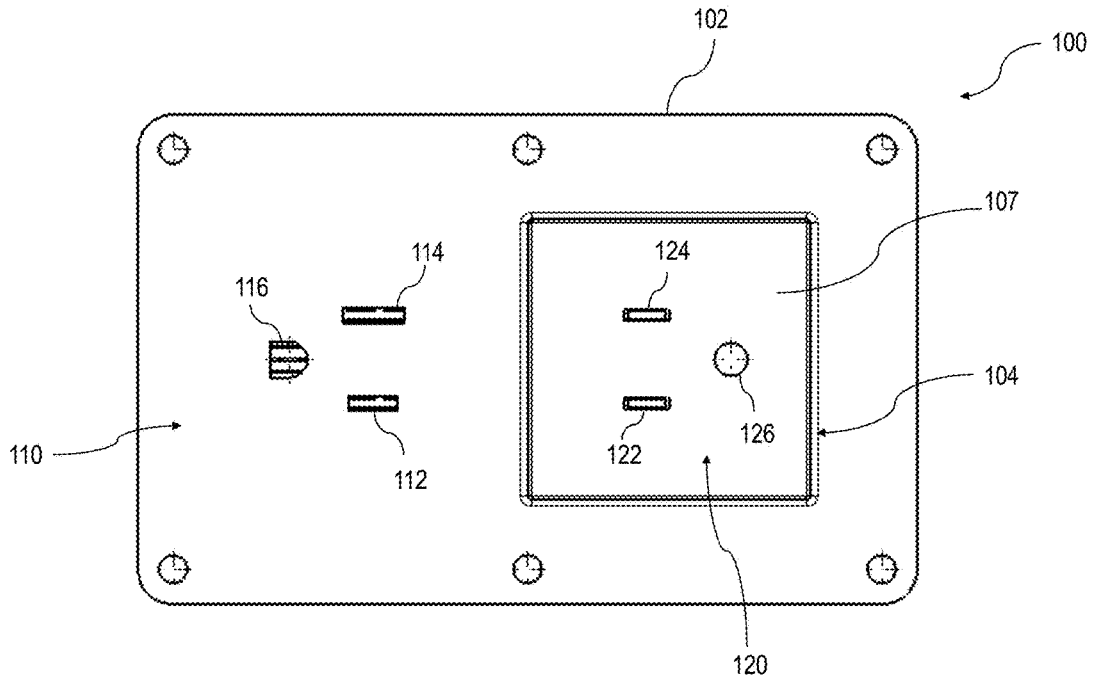
FIG. 3 depicts a frontal view of the AC inlet/outlet assembly, according to an embodiment.

FIGS. 1-3 depict perspective, side, and frontal views of an AC inlet/outlet assembly 100, according to an embodiment of the invention. In an embodiment, assembly 100 houses an AC (female) outlet 110 and an AC (male) inlet 120 coupled together in a water-sealed fashion within a single body. The assembly 100 includes a front face 102 including slots 112, 114, 116 that house the respective line, neutral, and ground terminals of the AC outlet 110. In an embodiment, the slots 112, 114 and 116 may include a seal such around each of the terminals of the AC outlet 110 to avoid water leakage through the slots 112, 114 and 116. The front face 102 also includes a recessed portion 104 formed by a series of side walls 106 and a rear wall 107 formed around the AC inlet 120 terminals (i.e., line, neutral and ground terminals 122, 124 and 126). In an embodiment, the rear wall 107 may be insert-molded around the terminals 122, 124 and 126 to avoid water leakage to the rear side of the real wall 107.

In an embodiment, the AC outlet 110 and AC inlet 120 terminals are arranged to be a mirror image of one another, as shown in FIG. 3. In the illustrative example, the ground terminals are arranged on the outside.

In an embodiment, the assembly 100 further includes a rear main body 130 that includes channels and structure to electrically connect corresponding terminals of the AC outlet 110 and AC inlet 120, as described herein in detail.

Figure 4:
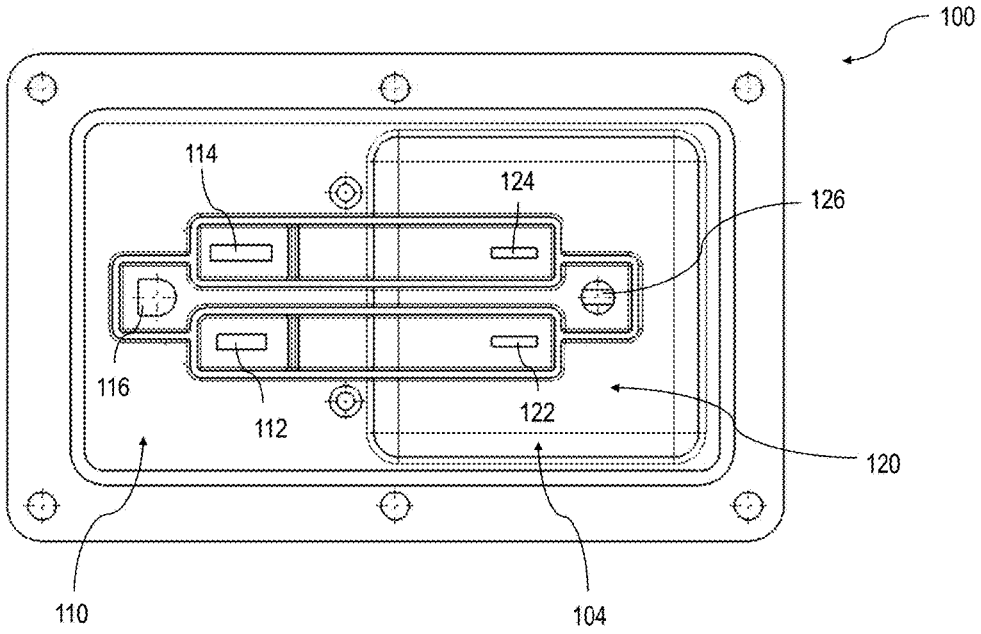
FIG. 4 depicts a frontal cross-sectional view of the AC inlet/outlet assembly showing sealed channels between the inlet and outlet terminals, according to an embodiment.
Figure 5:
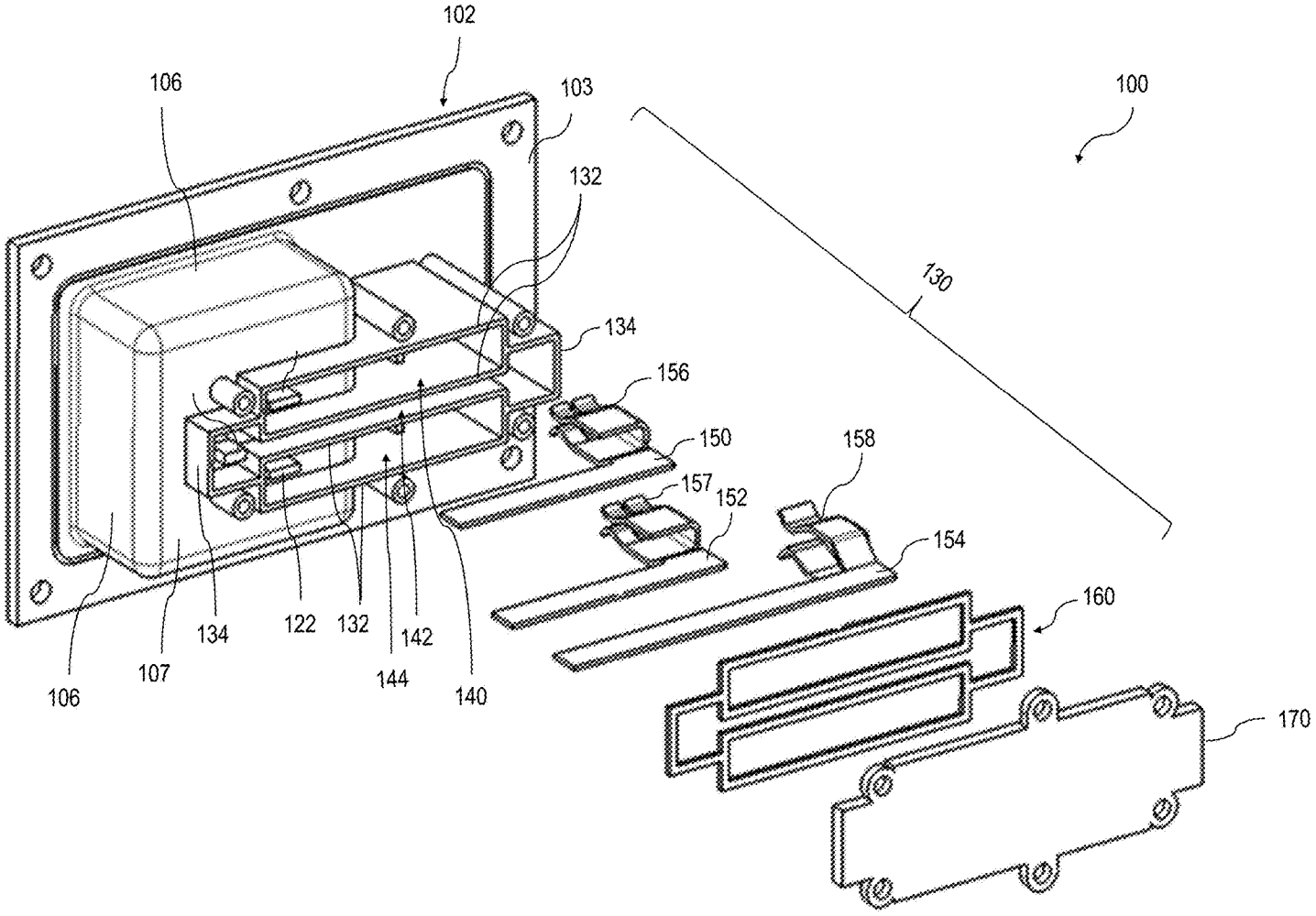
FIG. 5 depicts an exploded perspective view of the AC inlet/outlet assembly, according to an embodiment.

FIG. 4 depicts a front cross-sectional view of the AC inlet/outlet assembly 100 showing the internal components for connecting the AC outlet 110 and AC inlet 120. FIG. 5 depicts a rear perspective exploded view of the AC inlet/outlet assembly 100 including the internal components of the main body 130 in an exploded form, according to an embodiment.

As shown in these figures, in an embodiment, the main body 130 includes a series of lateral walls 132, 134 projecting rearwardly from the rear face 103 opposite the front face 102. The walls 132, 134 form first, second and third channels 140, 142, and 144 between the line, neutral, and ground terminals (not shown) of the AC outlet 110 and the line, neutral, and ground terminals 122, 124 and 126 of the AC inlet 120. These channels 140, 142, and 144 extend laterally from the rear face 103 and are separated from one another via lateral walls 132 and 134. In an embodiment, the three channels 140, 142 and 144 are arranged in parallel along a plane that is parallel to a plane of the front face 102 of the inlet/outlet assembly 100.

In an embodiment, the main body 130 further includes a series of first, second, and third connectors 150, 152, 154 received within respective channels 140, 142, and 144. Each connector 150, 152, 154 includes an elongated metallic body, ends of which electrically connects with the line, neutral, and ground terminals (not shown) of the AC outlet 110 and the line, neutral, and ground terminals 122, 124 and 126 of the AC inlet 120. In an embodiment, each connector 150, 152, 154 includes a lateral receptacle tabs 156, 157, and 158 that received the ends of the line, neutral, and ground terminals (not shown) of the AC outlet 110 therein.

In an embodiment, the main body 130 further includes a gasket 160 and a cover 170. The gasket 160, in an embodiment, includes the same profile as the walls 132 and 134, and is disposed between the ends of the walls 132 and 134 and the cover 170 to form a water-seal coupling. The cover 170 and the gasket 160 together fully seal the channels 140, 142, and 144 to block any fluid communication between the channels 140, 142, and 144, and from the outside environment. In an embodiment, the cover 170 is fastened to the main body 130 via screws.

Figure 6:
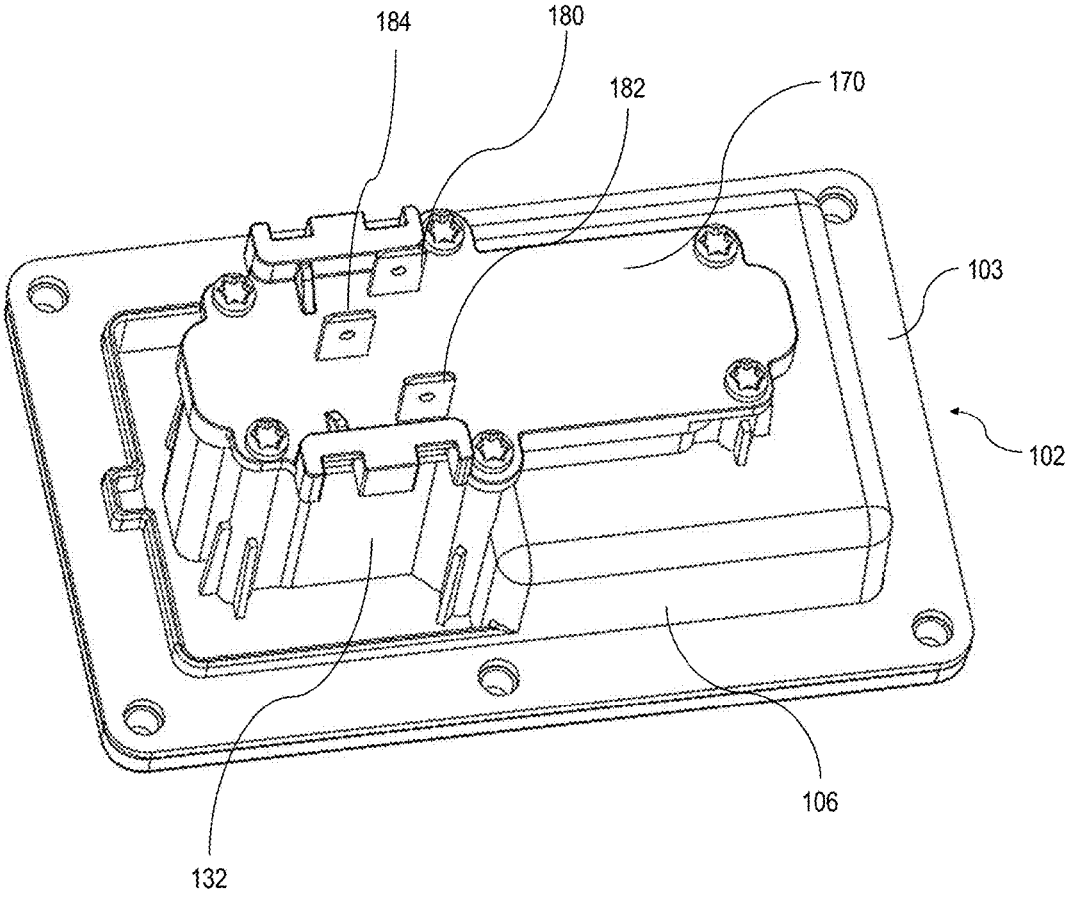
FIG. 6 depicts a rear perspective view of an AC inlet/outlet assembly, according to an additional and/or alternative embodiment.

In an embodiment, as shown in FIG. 6, additional line, neutral, and ground terminals 180, 182, 184 are coupled to the connectors 150, 152, 154 through the cover 170. One the assembly 100 is mounted on a device such as a light, a vacuum device, etc., the terminals 180, 182, 184 allow for electric connectivity of the device to the AC outlet 110 and AC inlet 120. In an embodiment, the cover 170 may be insert-molded or otherwise sealed outside the periphery of the terminals 180, 182, 184.

Figure 7:
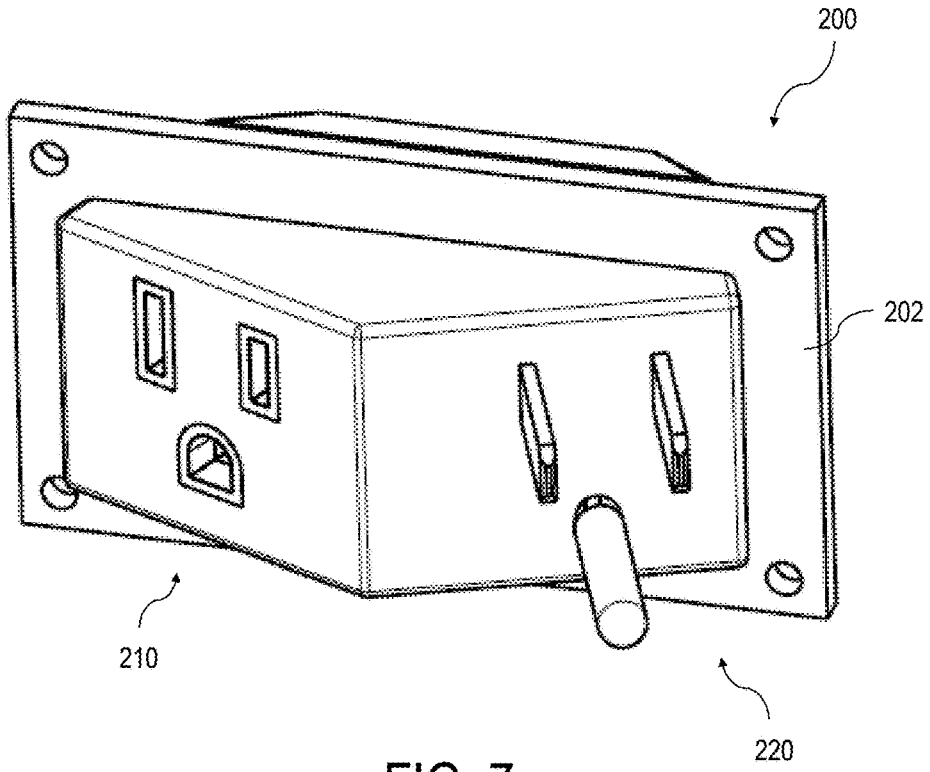
FIG. 7 depicts a perspective view of an AC inlet/outlet assembly, according to an alternative embodiment.
Figure 8:
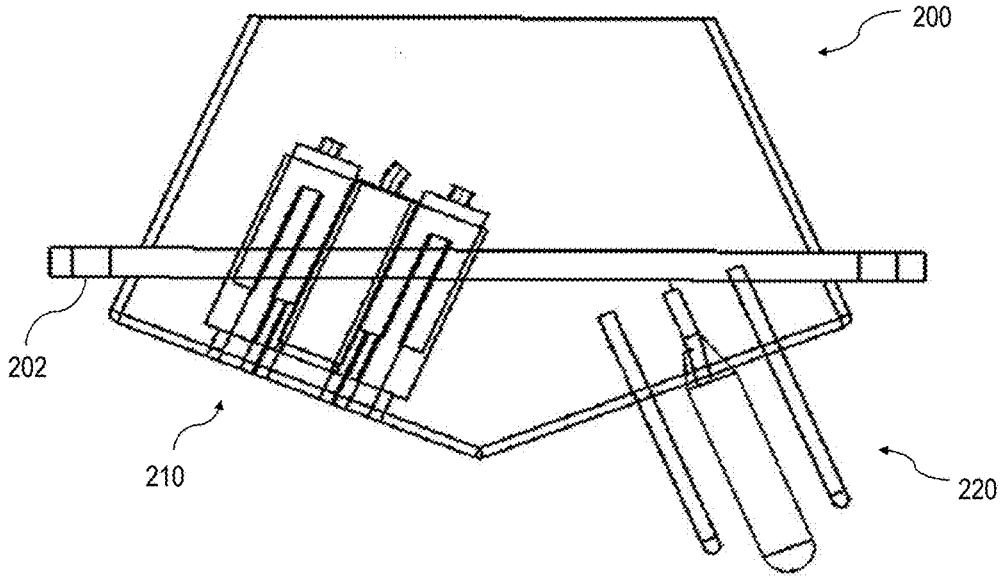
FIG. 8 depicts a top cross-sectional view of the AC inlet/outlet assembly of FIG. 7, according to an alternative embodiment.

FIGS. 7 and 8 depict perspective and top cross-sectional views an AC inlet/outlet assembly 200, according to an alternative embodiment. In this embodiment, the AC inlet 210 and AC outlet 220 are arranged at an angle (e.g. greater than 90 degrees and smaller than 180 degrees) with respect to one another. A series of lateral sealed channels (not shown) are formed between the corresponding line, neutral, and ground terminals of the inlet 210 and outlet 220. Because the inlet 210 and outlet 220 are arranged at an angle, corresponding terminals need not be arranged in mirror image of one another. In an embodiment, the channels may be disposed in sequence along a plane that is perpendicular to a plane of a front face 202 of the inlet/outlet assembly 200.

Figure 9:
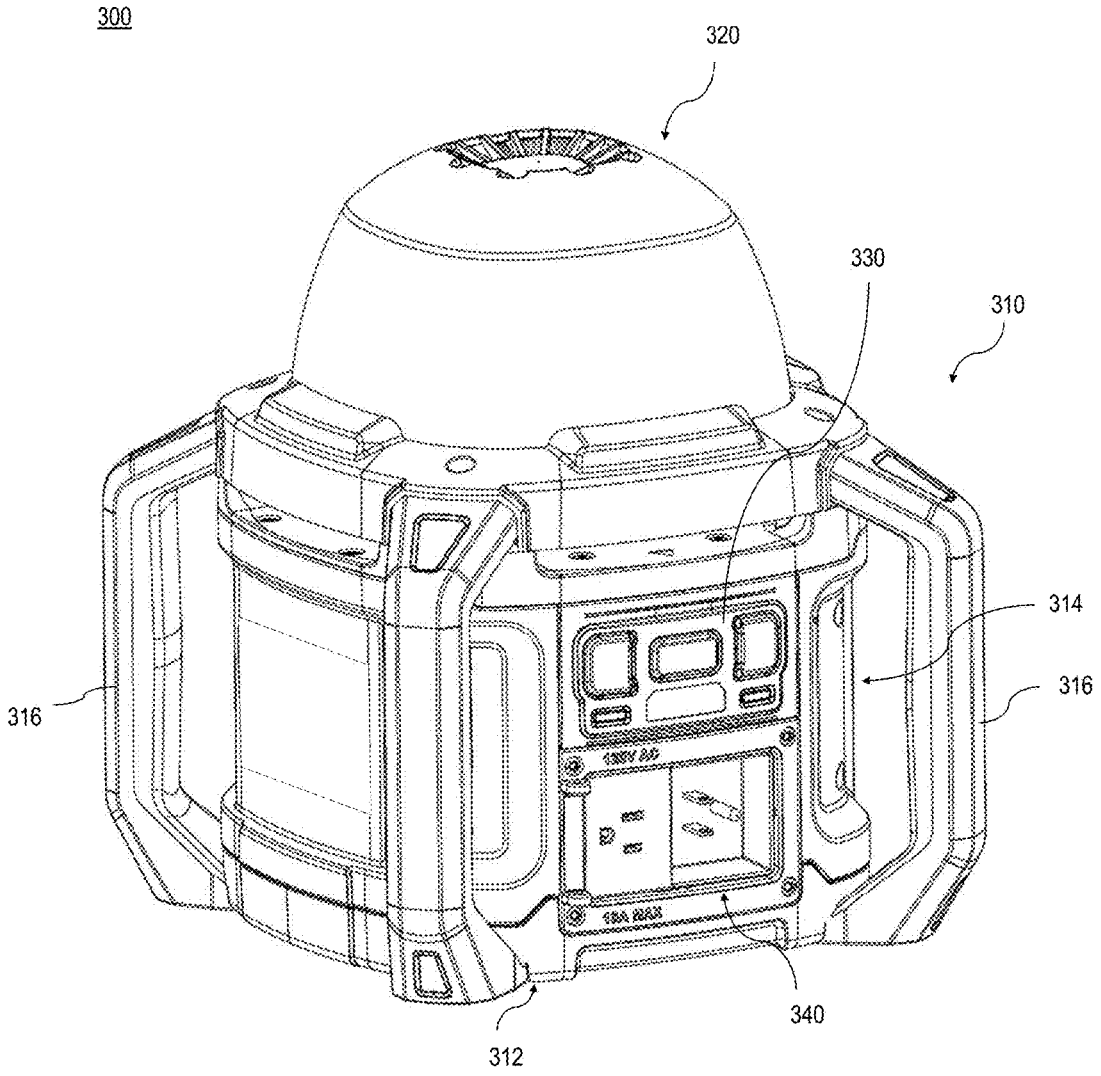
FIG. 9 depicts an exemplary lighting device employing an exemplary AC inlet/outlet assembly, according to an embodiment.

FIG. 9 depicts a perspective view of an exemplary lighting device 300 employing an exemplary AC inlet/outlet assembly, according to an embodiment of the invention.

In an embodiment, the lighting device 300 includes a main body 310 and a head portion 320 accommodating at least one Light Emitting Diode (LED) (not shown).

In an embodiment, the main body 310 includes a substantially square-shaped or circular base 312 and a cubical or cylindrical body 314. Four vertical side handles 316 are disposed around the main body 110. The main body 310 includes a control interface 330 for receiving control commands from a user. The control interface 330 includes push-buttons and/or other control mechanism for turning the lighting device ON and OFF, mode selection, etc. Mode selection, in an embodiment, correlates to the amount of light output (i.e., brightness) of the LED. In an embodiment, main body 310 also includes the AC inlet/outlet assembly 340, constructed according to any of the above-described embodiments, for receiving AC power from an AC power supply and supplying AC power to another electrical device such as a lighting device.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. An electrical inlet/outlet assembly comprising:

an Alternating Current (AC) inlet having at least a line terminal and a neutral terminal arranged to receive electric power from a power supply via a first power;

an AC outlet having at least a line terminal and a neutral terminal arranged to supply electric power from the AC inlet to an electrical device;

a front face having a planar portion through which the AC inlet and AC outlet are disposed;

a rear face opposite the front face;

a plurality of lateral walls projecting rearwardly from the rear face to form a plurality of channels therebetween on the rear face, the plurality of channels extending respectively between the line and neutral terminals of the AC inlet and the line and neutral terminals of the AC outlet; and a plurality of connectors disposed within the plurality of channels to electrically connect the line and neutral terminals of the AC inlet respectively to the line and neutral terminals of the AC outlet, wherein the plurality of channels forms water-sealed enclosures around the plurality of connectors, and wherein the line and neutral terminals of the AC inlet and the line and neutral terminals of the AC outlet are arranged in a mirror-image arrangement, and the plurality of channels extend in parallel from the line and neutral terminals of the AC inlet to the line and neutral terminals of the AC outlet respectively along a plane that is substantially parallel to the planar portion of the front face.

2. The electrical inlet/outlet assembly of claim 1, wherein the plurality of channels are formed in parallel and separated via at least one of the plurality of lateral walls.

3. The electrical inlet/outlet assembly of claim 1, further comprising:

a cover disposed at the ends of the plurality of lateral walls opposite the rear face; and a gasket disposed between the cover and the ends of the plurality of lateral walls to water-seal the plurality of channels.

4. The electrical inlet/outlet assembly of claim 3, further comprising an additional set of line and neutral terminals coupled to the plurality of connectors and projecting through the cover.

5. The electrical inlet/outlet assembly of claim 4, wherein the cover is insert-molded or otherwise sealed around the periphery of the additional set of line and neutral terminals.

6. The electrical inlet/outlet assembly of claim 1, wherein the line and neutral terminals of the AC inlet and the line and neutral terminals of the AC outlet are arranged in a mirror-image arrangement, and the plurality of channels extend in parallel from the line and neutral terminals of the AC inlet to the line and neutral terminals of the AC outlet respectively along a plane that is substantially parallel to the planar portion of the front face.

7. The electrical inlet/outlet assembly of claim 1, wherein the AC inlet and the AC outlet are arranged at an angle of less than 180 degrees with respect to one another.

8. The electrical inlet/outlet assembly of claim 1, wherein each of the AC inlet and AC outlet additionally comprises a ground terminal.

9. A lighting device having a main body, a light portion mounted on the main body, and an electrical inlet/outlet assembly disposed on the main body, the electrical inlet/outlet assembly comprising:

an Alternating Current (AC) inlet having at least a line terminal and a neutral terminal arranged to receive electric power from a power supply;

an AC outlet having at least a line terminal and a neutral terminal arranged to supply electric power from the AC inlet to another electrical device;

a front face having a planar portion through which the AC inlet and AC outlet are disposed;

a rear face opposite the front face;

a plurality of lateral walls projecting rearwardly from the rear face to form a plurality of channels therebetween on the rear face, the plurality of channels extending respectively between the line and neutral terminals of the AC inlet and the line and neutral terminals of the AC outlet; and a plurality of connectors disposed within the plurality of channels to electrically connect the line and neutral terminals of the AC inlet respectively to the line and neutral terminals of the AC outlet;

a cover disposed at the ends of the plurality of lateral walls opposite the rear face;

an additional set of line and neutral terminals coupled to the plurality of connectors and projecting through the cover to supply electric power from the AC inlet to the light portion; and a gasket disposed between the cover and the ends of the plurality of lateral walls to water-seal the plurality of channels, wherein the plurality of channels forms water-sealed enclosures around the plurality of connectors.

10. The lighting device of claim 9, wherein the channels are formed in parallel and separated via at least one of the plurality of lateral walls.

11. The lighting device of claim 9, wherein the line and neutral terminals of the AC inlet and the line and neutral terminals of the AC outlet are arranged in a mirror-image arrangement, and the plurality of channels extend in parallel from the line and neutral terminals of the AC inlet to the line and neutral terminals of the AC outlet respectively along a plane that is substantially parallel to the planar portion of the front face.

12. The lighting device of claim 9, wherein the AC inlet and the AC outlet are arranged at an angle of less than 180 degrees with respect to one another.

13. The lighting device of claim 9, wherein each of the AC inlet and AC outlet additionally comprises a ground terminal.

14. A lighting device having a main body, a light portion mounted on the main body, and an electrical inlet/outlet assembly disposed on the main body, the electrical inlet/outlet assembly comprising:

an Alternating Current (AC) inlet having at least a line terminal and a neutral terminal arranged to receive electric power from a power supply;

an AC outlet having at least a line terminal and a neutral terminal arranged to supply electric power from the AC inlet to another electrical device;

a front face having a planar portion through which the AC inlet and AC outlet are disposed;

a rear face opposite the front face;

a plurality of lateral walls projecting rearwardly from the rear face to form a plurality of channels therebetween on the rear face, the plurality of channels extending respectively between the line and neutral terminals of the AC inlet and the line and neutral terminals of the AC outlet;

a plurality of connectors disposed within the plurality of channels to electrically connect the line and neutral terminals of the AC inlet respectively to the line and neutral terminals of the AC outlet;

a cover disposed at the ends of the plurality of lateral walls opposite the rear face; and a gasket disposed between the cover and the ends of the plurality of lateral walls to water-seal the plurality of channels, wherein the plurality of channels forms water-sealed enclosures around the plurality of connectors, and wherein the line and neutral terminals of the AC inlet and the line and neutral terminals of the AC outlet are arranged in a mirror-image arrangement, and the plurality of channels extend in parallel from the line and neutral terminals of the AC inlet to the line and neutral terminals of the AC outlet respectively along a plane that is substantially parallel to the planar portion of the front face.

* * * * *